United States Patent [19]

Eastlund

[11] Patent Number: 4,686,605

[45] Date of Patent: Aug. 11, 1987

[54] METHOD AND APPARATUS FOR ALTERING A REGION IN THE EARTH'S ATMOSPHERE, IONOSPHERE, AND/OR MAGNETOSPHERE

[75] Inventor: Bernard J. Eastlund, Spring, Tex.

[73] Assignee: APTI, Inc., Los Angeles, Calif.

[21] Appl. No.: 690,333

[22] Filed: Jan. 10, 1985

[51] Int. Cl.[4] ..... H05B 6/64; H05C 3/00; H05H 1/46

[52] U.S. Cl. ..... 361/231; 89/1.11; 380/59; 244/158 R

[58] Field of Search ..... 361/230, 231; 244/158 R; 376/100; 89/1.11; 380/59

[56] References Cited

PUBLICATIONS

Liberty Magazine, (2/35) p. 7 N. Tesla.
New York Times (9/22/40) Section 2, p. 7 W. L. Laurence.
New York Times (12/8/15) p. 8 Col. 3.

*Primary Examiner*—Salvatore Cangialosi
*Attorney, Agent, or Firm*—Roderick W. MacDonald

[57] ABSTRACT

A method and apparatus for altering at least one selected region which normally exists above the earth's surface. The region is excited by electron cyclotron resonance heating to thereby increase its charged particle density. In one embodiment, circularly polarized electromagnetic radiation is transmitted upward in a direction substantially parallel to and along a field line which extends through the region of plasma to be altered. The radiation is transmitted at a frequency which excites electron cyclotron resonance to heat and accelerate the charged particles. This increase in energy can cause ionization of neutral particles which are then absorbed as part of the region thereby increasing the charged particle density of the region.

15 Claims, 5 Drawing Figures

FIG. 3
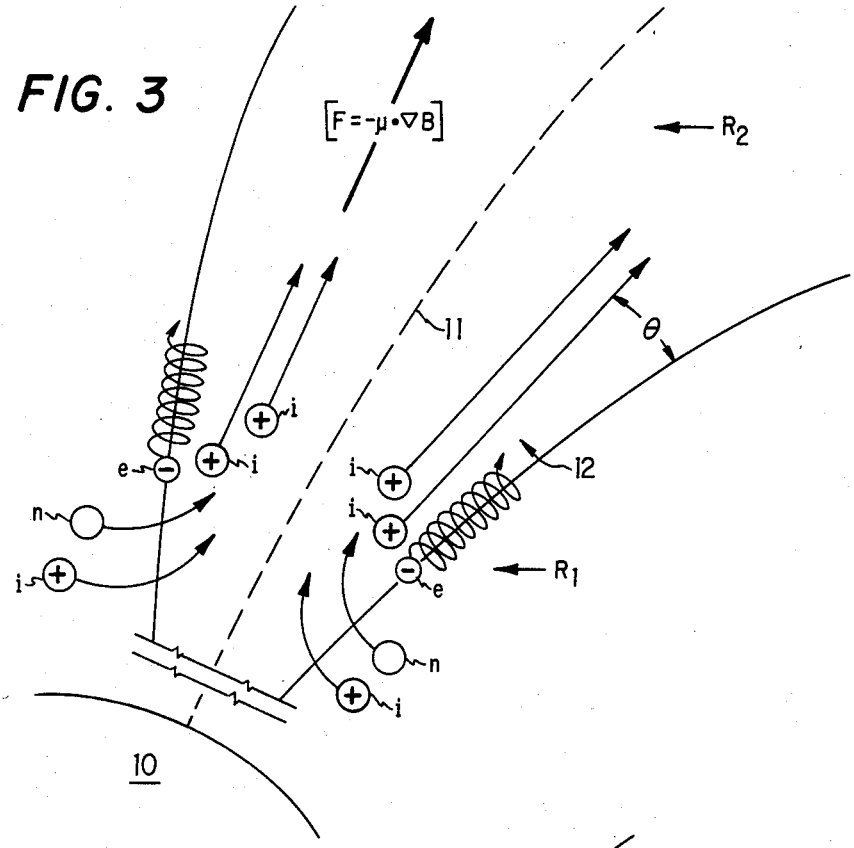
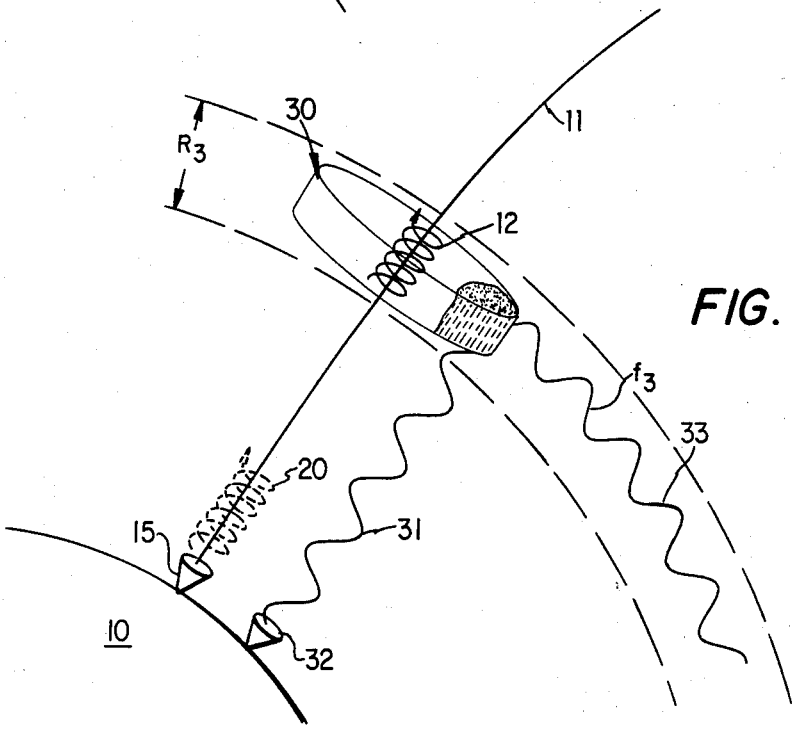
FIG. 4

METHOD AND APPARATUS FOR ALTERING A REGION IN THE EARTH'S ATMOSPHERE, IONOSPHERE, AND/OR MAGNETOSPHERE

DESCRIPTION

1. Technical Field

This invention relates to a method and apparatus for altering at least one selected region normally existing above the earth's surface and more particularly relates to a method and apparatus for altering said at least one region by initially transmitting electromagnetic radiation from the earth's surface essentially parallel to and along naturally-occurring, divergent magnetic field lines which extend from the earth's surface through the region or regions to be altered.

2. Background Art

In the late 1950's, it was discovered that naturally-occuring belts exist at high altitudes above the earth's surface, and it is now established that these belts result from charged electrons and ions becoming trapped along the magnetic lines of force (field lines) of the earth's essentially dipole magnetic field. The trapped electrons and ions are confined along the field lines between two magnetic mirrors which exist at spaced apart points along those field lines. The trapped electrons and ions move in helical paths around their particular field lines and "bounce" back and forth between the magnetic mirrors. These trapped electrons and ions can oscillate along the field lines for long periods of time.

In the past several years, substantial effort has been made to understand and explain the phenomena involved in belts of trapped electrons and ions, and to explore possible ways to control and use these phenomena for beneficial purposes. For example, in the late 1950's and early 1960's both the United States and U.S.S.R. detonated a series of nuclear devices of various yields to generate large numbers of charged particles at various altitudes, e.g., 200 kilometers (km) or greater. This was done in order to establish and study artifical belts of trapped electrons and ions. These experiments established that at least some of the extraneous electrons and ions from the detonated devices did become trapped along field lines in the earth's magnetosphere to form artificial belts which were stable for prolonged periods of time. For a discussion of these experiments see "The Radiation Belt and Magnetosphere", W. N. Hess, Blaisdell Publishing Co., 1968, pps. 155 et sec.

Other proposals which have been advanced for altering existing belts of trapped electrons and ions and/or establishing similar artificial belts include injecting charged particles from a satellite carrying a payload of radioactive beta-decay material or alpha emitters; and injecting charged particles from a satellite-borne electron accelerator. Still another approach is described in U.S. Pat. No. 4,042,196 wherein a low energy ionized gas, e.g., hydrogen, is released from a synchronous orbiting satellite near the apex of a radiation belt which is naturally-occurring in the earth's magnetosphere to produce a substantial increase in energetic particle precipitation and, under certain conditions, produce a limit in the number of particles that can be stably trapped. This precipitation effect arises from an enhancement of the whistler-mode and ion-cyclotron mode interactions that result from the ionized gas or "cold plasma" injection.

It has also been proposed to release large clouds of barium in the magnetosphere so that photoionization will increase the cold plasma density, thereby producing electron precipitation through enhanced whistler-mode interactions.

However, in all of the above-mentioned approaches, the mechanisms involved in triggering the change in the trapped particle phenomena must be actually positioned within the affected zone, e.g., the magnetosphere, before they can be actuated to effect the desired change.

The earth's ionosphere is not considered to be a "trapped" belt since there are few trapped particles therein. The term "trapped" herein refers to situations where the force of gravity on the trapped particles is balanced by magnetic forces rather than hydrostatic or collisional forces. The charged electrons and ions in the ionosphere also follow helical paths around magnetic field lines within the ionosphere but are not trapped between mirrors, as in the case of the trapped belts in the magnetosphere, since the gravitational force on the particles is balanced by collisional or hydrostatic forces.

In recent years, a number of experiments have actually been carried out to modify the ionosphere in some controlled manner to investigate the possibility of a beneficial result. For detailed discussions of these operations see the following papers: (1) Ionospheric Modification Theory; G. Meltz and F. W. Perkins; (2) The Platteville High Power Facility; Carrol et al.; (3) Arecibo Heating Experiments; W. E. Gordon and H. C. Carlson, Jr.; and (4) Ionospheric Heating by Powerful Radio Waves; Meltz et al., all published in Radio Science, Vol. 9, No. 11, November, 1974, at pages 885–888; 889–894; 1041–1047; and 1049–1063, respectively, all of which are incorporated herein by reference. In such experiments, certain regions of the ionosphere are heated to change the electron density and temperature within these regions. This is accomplished by transmitting from earth-based antennae high frequency electromagnetic radiation at a substantial angle to, not parallel to, the ionosphere's magnetic field to heat the ionospheric particles primarily by ohmic heating. The electron temperature of the ionosphere has been raised by hundreds of degrees in these experiments, and electrons with several electron volts of energy have been produced in numbers sufficient to enhance airglow. Electron concentrations have been reduced by a few percent, due to expansion of the plasma as a result of increased temperature.

In the Elmo Bumpy Torus (EBT), a controlled fusion device at the Oak Ridge National Laboratory, all heating is provided by microwaves at the electron cyclotron resonance interaction. A ring of hot electrons is formed at the earth's surface in the magnetic mirror by a combination of electron cyclotron resonance and stochastic heating. In the EBT, the ring electrons are produced with an average "temperature" of 250 kilo electron volts or kev ($2.5\times10^9$K) and a plasma beta between 0.1 and 0.4; see, "A Theoretical Study of Electron—Cyclotron Absorption in Elmo Bumpy Torus", Batchelor and Goldfinger, Nuclear Fusion, Vol. 20, No. 4 (1980) pps. 403–418.

Electron cyclotron resonance heating has been used in experiments on the earth's surface to produce and accelerate plasmas in a diverging magnetic field. Kosmahl et al. showed that power was transferred from the electromagnetic waves and that a fully ionized plasma was accelerated with a divergence angle of roughly 13 degrees. Optimum neutral gas density was $1.7\times10^{14}$per cubic centimeter; see, "Plasma Acceleration with Microwaves Near Cyclotron Resonance", Kosmahl et al., Journal of Applied Physics, Vol. 38, No. 12, Nov., 1967, pps. 4576–4582.

DISCLOSURE OF THE INVENTION

The present invention provides a method and apparatus for altering at least one selected region which normally exists above the earth's surface. The region is excited by electron cyclotron resonance heating of electrons which are already present and/or artifically created in the region to thereby increase the charged particle energy and ultimately the density of the region.

In one embodiment this is done by transmitting circularly polarized electromagnetic radiation from the earth's surface at or near the location where a naturally-occurring dipole magnetic field (force) line intersects the earth's surface. Right hand circular polarization is used in the northern hemisphere and left hand circular polarization is used in the southern hemisphere. The radiation is deliberately transmitted at the outset in a direction substantially parallel to and along a field line which extends upwardly through the region to be altered. The radiation is transmitted at a frequency which is based on the gyrofrequency of the charged particles and which, when applied to the at least one region, excites electron cyclotron resonance within the region or regions to heat and accelerate the charged particles in their respective helical paths around and along the field line. Sufficient energy is employed to cause ionization of neutral particles (molecules of oxygen, nitrogen and the like, particulates, etc.) which then become a part of the region thereby increasing the charged particle density of the region. This effect can further be enhanced by providing artificial particles, e.g., electrons, ions, etc., directly into the region to be affected from a rocket, satellite, or the like to supplement the particles in the naturally-occurring plasma. These artificial particles are also ionized by the transmitted electromagnetic radiation thereby increasing charged particle density of the resulting plasma in the region.

In another embodiment of the invention, electron cyclotron resonance heating is carried out in the selected region or regions at sufficient power levels to allow a plasma present in the region to generate a mirror force which forces the charged electrons of the altered plasma upward along the force line to an altitude which is higher than the original altitude. In this case the relevant mirror points are at the base of the altered region or regions. The charged electrons drag ions with them as well as other particles that may be present. Sufficient power, e.g., $10^{15}$joules, can be applied so that the altered plasma can be trapped on the field line between mirror points and will oscillate in space for prolonged periods of time. By this embodiment, a plume of altered plasma can be established at selected locations for communication modification or other purposes.

In another embodiment, this invention is used to alter at least one selected region of plasma in the ionosphere to establish a defined layer of plasma having an increased charged particle density. Once this layer is established, and while maintaining the transmission of the main beam of circularly polarized electromagnetic radiation, the main beam is modulated and/or at least one second different, modulated electromagnetic radiation beam is transmitted from at least one separate source at a different frequency which will be absorbed in the plasma layer. The amplitude of the frequency of the main beam and/or the second beam or beams is modulated in resonance with at least one known oscillation mode in the selected region or regions to excite the known oscillation mode to propagate a known frequency wave or waves throughout the ionosphere.

BRIEF DESCRIPTION OF THE DRAWINGS

The actual construction, operation, and apparent advantages of this invention will be better understood by referring to the drawings in which like numerals identify like parts and in which:

FIG. 3 is a simplified, idealized representation of a physical phenomenon involved in the present invention; and FIG. 4 is a schematic view of another embodiment within the present invention.

BEST MODES FOR CARRYING OUT THE INVENTION

Figure 1:
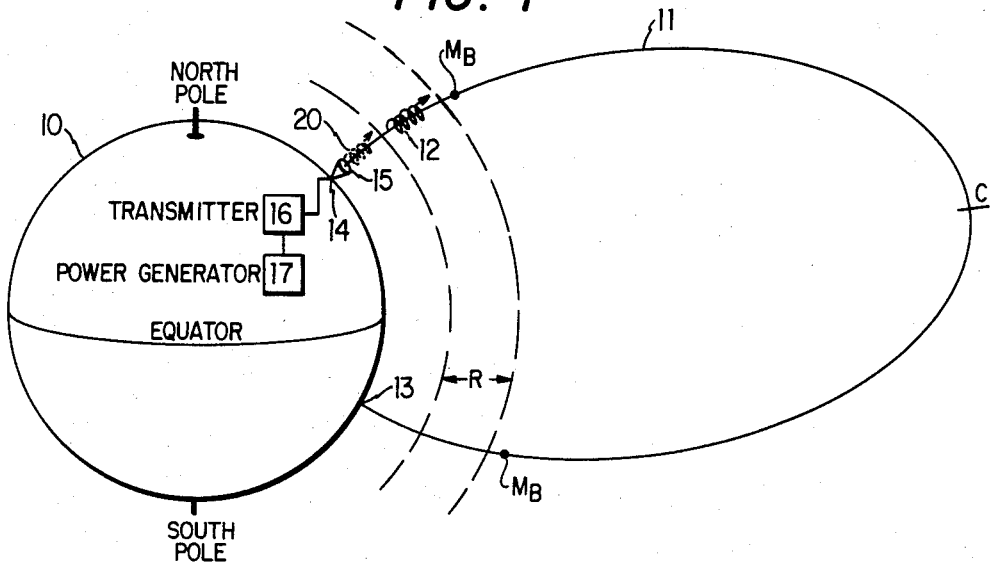
FIG. 1 is a simplified schematical view of the earth (not to scale) with a magnetic field (force) line along which the present invention is carried out.

The earth's magnetic field is somewhat analogous to a dipole bar magnet. As such, the earth's magnetic field contains numerous divergent field or force lines, each line intersecting the earth's surface at points on opposite sides of the Equator. The field lines which intersect the earth's surface near the poles have apexes which lie at the furthest points in the earth's magnetosphere while those closest to the Equator have apexes which reach only the lower portion of the magnetosphere.

At various altitudes above the earth's surface, e.g., in both the ionosphere and the magnetosphere, plasma is naturally present along these field lines. This plasma consists of equal numbers of positively and negatively charged particles (i.e., electrons and ions) which are guided by the field line. It is well established that a charged particle in a magnetic field gyrates about field lines, the center of gyration at any instance being called the "guiding center" of the particle. As the gyrating particle moves along a field line in a uniform field, it will follow a helical path about its guiding center, hence linear motion, and will remain on the field line. Electrons and ions both follow helical paths around a field line but rotate in opposite directions. The frequencies at which the electrons and ions rotate about the field line are called gyromagnetic frequencies or cyclotron frequencies because they are identical with the expression for the angular frequencies of gyration of particles in a cyclotron. The cyclotron frequency of ions in a given magnetic field is less than that of electrons, in inverse proportion to their masses.

If the particles which form the plasma along the earth's field lines continued to move with a constant pitch angle, often designated "alpha", they would soon impact on the earth's surface. Pitch angle alpha is defined as the angle between the direction of the earth's magnetic field and the velocity (V) of the particle. However, in converging force fields, the pitch angle does change in such a way as to allow the particle to turn around and avoid impact. Consider a particle moving along a field line down toward the earth. It moves into a region of increasing magnetic field strength and therefore sine alpha increases. But sine alpha can only increase to 1.0, at which point, the particle turns around and starts moving up along the field line, and alpha decreases. The point at which the particle turns around is called the mirror point, and there alpha equals ninety degrees. This process is repeated at the other end of the field line where the same magnetic field strength value B, namely Bm, exists. The particle again turns around and this is called the "conjugate point" of the original mirror point. The particle is therefore trapped and bounces between the two magnetic mirrors. The particle can continue oscillating in space in this manner for long periods of time. The actual place where a particle will mirror can be calculated from the following:

$$\sin^2 \text{alpha}_o = B_o/B_m \quad (1)$$

wherein:

$\text{alpha}_o$=equatorial pitch angle of particle $B_o$=equatorial field strength on a particular field line $B_m$=field strength at the mirror point Recent discoveries have established that there are substantial regions of naturally trapped particles in space which are commonly called "trapped radiation belts". These belts occur at altitudes greater than about 500 km and accordingly lie in the magnetosphere and mostly above the ionosphere.

The ionosphere, while it may overlap some of the trapped-particle belts, is a region in which hydrostatic forces govern its particle distribution in the gravitational field. Particle motion within the ionosphere is governed by both hydrodynamic and electrodynamic forces. While there are few trapped particles in the ionosphere, nevertheless, plasma is present along field lines in the ionosphere. The charged particles which form this plasma move between collisions with other particles along similar helical paths around the field lines and although a particular particle may diffuse downward into the earth's lower atmosphere or lose energy and diverge from its original field line due to collisions with other particles, these charged particles are normally replaced by other available charged particles or by particles that are ionized by collision with said particle. The electron density ($N_e$) of the plasma will vary with the actual conditions and locations involved. Also, neutral particles, ions, and electrons are present in proximity to the field lines.

The production of enhanced ionization will also alter the distribution of atomic and molecular constituents of the atmosphere, most notably through increased atomic nitrogen concentration. The upper atmosphere is normally rich in atomic oxygen (the dominant atmospheric constituent above 200 km altitude), but atomic nitrogen is normally relatively rare. This can be expected to manifest itself in increased airglow, among other effects.

As known in plasma physics, the characteristics of a plasma can be altered by adding energy to the charged particles or by ionizing or exciting additional particles to increase the density of the plasma. One way to do this is by heating the plasma which can be accomplished in different ways, e.g., ohmic, magnetic compression, shock waves, magnetic pumping, electron cyclotron resonance, and the like.

Since electron cyclotron resonance heating is involved in the present invention, a brief discussion of same is in order. Increasing the energy of electrons in a plasma by invoking electron cyclotron resonance heating, is based on a principle similar to that utilized to accelerate charged particles in a cyclotron. If a plasma is confined by a static axial magnetic field of strength B, the charged particles will gyrate about the lines of force with a frequency given, in hertz, as $f_g = 1.54 \times 10^3 B/A$, where: B=magnetic field strength in gauss, and A=mass number of the ion.

Suppose a time-varying field of this frequency is superimposed on the static field B confining the plasma, by passage of a radiofrequency current through a coil which is concentric with that producing the axial field, then in each half-cycle of their rotation about the field lines, the charged particles acquire energy from the oscillating electric field associated with the radio frequency. For example, if B is 10,000 gauss, the frequency of the field which is in resonance with protons in a plasma is 15.4 megahertz.

As applied to electrons, electron cyclotron resonance heating requires an oscillating field having a definite frequency determined by the strength of the confining field. The radio-frequency radiation produces time-varying fields (electric and magnetic), and the electric field accelerates the charged particle. The energized electrons share their energy with ions and neutrals by undergoing collisions with these particles, thereby effectively raising the temperature of the electrons, ions, and neutrals. The apportionment of energy among these species is determined by collision frequencies. For a more detailed understanding of the physics involved, see "Controlled Thermonuclear Reactions", Glasstone and Lovberg, D. Van Nostrand Company, Inc., Princeton, N.J., 1960 and "The Radiation Belt and Magnetosphere", Hess, Blaisdell Publishing Company, 1968, both of which are incorporated herein by reference.

Referring now to the drawings, the present invention provides a method and apparatus for altering at least one region of plasma which lies along a field line, particularly when it passes through the ionosphere and/or magnetosphere. FIG. 1 is a simplified illustration of the earth 10 and one of its dipole magnetic force or field lines 11. As will be understood, line 11 may be any one of the numerous naturally existing field lines and the actual geographical locations 13 and 14 of line 11 will be chosen based on a particular operation to be carried out. The actual locations at which field lines intersect the earth's surface is documented and is readily ascertainable by those skilled in the art.

Line 11 passes through region R which lies at an altitude above the earth's surface. A wide range of altitudes are useful given the power that can be employed by the practice of this invention. The electron cyclotron resonance heating effect can be made to act on electrons anywhere above the surface of the earth. These electrons may be already present in the atmosphere, ionosphere, and/or magnetosphere of the earth, or can be artificially generated by a variety of means such as x-ray beams, charged particle beams, lasers, the plasma sheath surrounding an object such as a missile or meteor, and the like. Further, artificial particles, e.g., electrons, ions, etc., can be injected directly into region R from an earth-launched rocket or orbiting satellite carrying, for example, a payload of radioactive beta-decay material; alpha emitters; an electron accelerator; and/or ionized gases such as hydrogen; see U.S. Pat. No. 4,042,196. The altitude can be greater than about 50 km if desired, e.g., can be from about 50 km to about 800 km, and, accordingly may lie in either the ionosphere or the magnetosphere or both. As explained above, plasma will be present along line 11 within region R and is represented by the helical line 12. Plasma 12 is comprised of charged particles (i.e., electrons and ions) which rotate about opposing helical paths along line 11.

Antenna 15 is positioned as close as is practical to the location 14 where line 11 intersects the earth's surface. Antenna 15 may be of any known construction for high directionality, for example, a phased array, beam spread angle ($\theta$) type. See "The MST Radar at Poker Flat, Alaska", Radio Science, Vol. 15, No. 2, Mar.-Apr. 1980, pps. 213–223, which is incorporated herein by reference. Antenna 15 is coupled to transmitter 16 which generates a beam of high frequency electromagnetic radiation at a wide range of discrete frequencies, e.g., from about 20 to about 1800 kilohertz (kHz).

Transmitter 16 is powered by power generator means 17 which is preferably comprised of one or more large, commercial electrical generators. Some embodiments of the present invention require large amounts of power, e.g., up to $10^9$to $10^{11}$watts, in continuous wave or pulsed power. Generation of the needed power is within the state of the art. Although the electrical generators necessary for the practice of the invention can be powered in any known manner, for example, by nuclear reactors, hydroelectric facilities, hydrocarbon fuels, and the like, this invention, because of its very large power requirement in certain applications, is particularly adapted for use with certain types of fuel sources which naturally occur at strategic geographical locations around the earth. For example, large reserves of hydrocarbons (oil and natural gas) exist in Alaska and Canada. In northern Alaska, particularly the North Slope region, large reserves are currently readily available. Alaska and northern Canada also are ideally located geographically as to magnetic latitudes. Alaska provides easy access to magnetic field lines that are especially suited to the practice of this invention, since many field lines which extend to desirable altitudes for this invention intersect the earth in Alaska. Thus, in Alaska, there is a unique combination of large, accessible fuel sources at desirable field line intersections. Further, a particularly desirable fuel source for the generation of very large amounts of electricity is present in Alaska in abundance, this source being natural gas. The presence of very large amounts of clean-burning natural gas in Alaskan latitudes, particularly on the North Slope, and the availability of magnetohydrodynamic (MHD), gas turbine, fuel cell, electrogasdynamic (EGD) electric generators which operate very efficiently with natural gas provide an ideal power source for the unprecedented power requirements of certain of the applications of this invention. For a more detailed discussion of the various means for generating electricity from hydrocarbon fuels, see "Electrical Aspects of Combustion", Lawton and Weinberg, Clarendon Press, 1969. For example, it is possible to generate the electricity directly at the high frequency needed to drive the antenna system. To do this, typically the velocity of flow of the combustion gases (v), past magnetic field perturbation of dimension d (in the case of MHD), follow the rule:

$$v = df$$

where f is the frequency at which electricity is generated. Thus, if $v = 1.78 \times 10^6$ cm/sec and d = 1 cm then electricity would be generated at a frequency of 1.78 mHz.

Put another way, in Alaska, the right type of fuel (natural gas) is naturally present in large amounts and at just the right magnetic latitudes for the most efficient practice of this invention, a truly unique combination of circumstances. Desirable magnetic latitudes for the practice of this invention interest the earth's surface both northerly and southerly of the equator, particularly desirable latitudes being those, both northerly and southerly, which correspond in magnitude with the magnetic latitudes that encompass Alaska.

Figure 2:
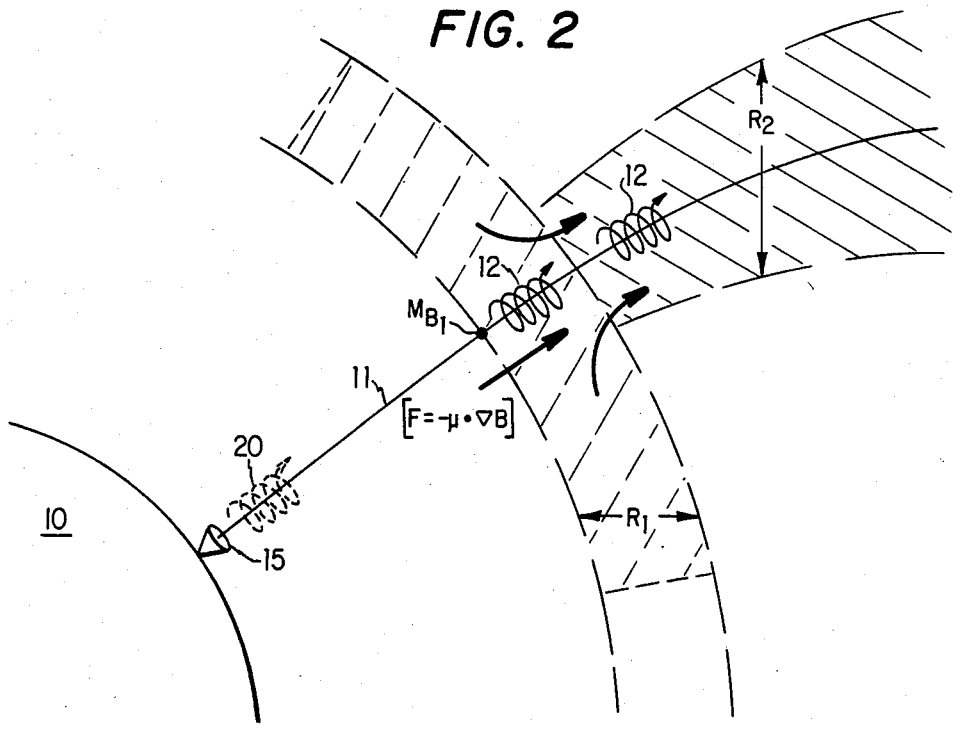
FIG. 2 is one embodiment within the present invention in which a selected region of plasma is raised to a higher altitude.

Referring now to FIG. 2 a first ambodiment is illustrated where a selected region $R_1$of plasma 12 is altered by electron cyclotron resonance heating to accelerate the electrons of plasma 12, which are following helical paths along field line 11.

To accomplish this result, electromagnetic radiation is transmitted at the outset, essentially parallel to line 11 via antenna 15 as right hand circularly polarized radiation wave 20. Wave 20 has a frequency which will excite electron cyclotron resonance with plasma 12 at its initial or original altitude. This frequency will vary depending on the electron cyclotron resonance of region $R_1$which, in turn, can be determined from available data based on the altitudes of region $R_1$, the particular field line 11 being used, the strength of the earth's magnetic field, etc. Frequencies of from about 20 to about 7200 kHz, preferably from about 20 to about 1800 kHz can be employed. Also, for any given application, there will be a threshhold (minimum power level) which is needed to produce the desired result. The minimum power level is a function of the level of plasma production and movement required, taking into consideration any loss processes that may be dominant in a particular plasma or propagation path.

As electron cyclotron resonance is established in plasma 12, energy is transferred from the electromagnetic radiation 20 into plasma 12 to heat and accelerate the electrons therein and, subsequently, ions and neutral particles. As this process continues, neutral particles which are present within $R_1$are ionized and absorbed into plasma 12 and this increases the electron and ion densities of plasma 12. As the electron energy is raised to values of about 1 kilo electron volt (kev), the generated mirror force (explained below) will direct the excited plasma 12 upward along line 11 to form a plume $R_2$at an altitude higher than that of $R_1$.

Plasma acceleration results from the force on an electron produced by a nonuniform static magnetic field ($\overline{B}$). The force, called the mirror force, is given by $$F = -\mu \nabla B \tag{2}$$

where $\mu$ is the electron magnetic moment and $\nabla \overline{B}$ is the gradient of the magnetic field, $\mu$ being further defined as:

$$W_\perp / B = m V_\perp^2 / 2B$$

where $W_\perp$is the kinetic energy in the direction perpendicular to that of the magnetic field lines and B is the magnetic field strength at the line of force on which the guiding center of the particle is located. The force as represented by equation (2) is the force which is responsible for a particle obeying equation (1).

Since the magnetic field is divergent in region $R_1$, it can be shown that the plasma will move upwardly from the heating region as shown in FIG. 1 and further it can be shown that $$\tfrac{1}{2}M_eV_{e\perp}^2(x) \approx \tfrac{1}{2}M_eV_{e\perp}^2(Y) + \tfrac{1}{2}M_iV_{i\parallel}^2(Y) \quad (3)$$

where the left hand side is the initial electron transverse kinetic energy; the first term on the right is the transverse electron kinetic energy at some point (Y) in the expanded field region, while the final term is the ion kinetic energy parallel to B at point (Y). This last term is what constitutes the desired ion flow. It is produced by an electrostatic field set up by electrons which are accelerated according to Equation (2) in the divergent field region and pulls ions along with them. Equation (3) ignores electron kinetic energy parallel to B because $V_{e\parallel} \approx V_{i\parallel}$, so the bulk of parallel kinetic energy resides in the ions because of their greater masses. For example, if an electromagnetic energy flux of from about 1 to about 10 watts per square centimeter is applied to region R, whose altitude is 115 km, a plasma having a density ($N_e$) of $10^{12}$ per cubic centimeter will be generated and moved upward to region $R_2$ which has an altitude of about 1000 km. The movement of electrons in the plasma is due to the mirror force while the ions are moved by ambipolar diffusion (which results from the electrostatic field). This effectively "lifts" a layer of plasma 12 from the ionosphere and/or magnetosphere to a higher elevation $R_2$. The total energy required to create a plasma with a base area of 3 square kilometers and a height of 1000 km is about $3\times10^{13}$ joules.

FIG. 3 is an idealized representation of movement of plasma 12 upon excitation by electron cyclotron resonance within the earth's divergent force field. Electrons (e) are accelerated to velocities required to generate the necessary mirror force to cause their upward movement. At the same time neutral particles (n) which are present along line 11 in region $R_1$are ionized and become part of plasma 12. As electrons (e) move upward along line 11, they drag ions (i) and neutrals (n) with them but at an angle $\theta$ of about 13 degrees to field line 11. Also, any particulates that may be present in region $R_1$, will be swept upwardly with the plasma. As the charged particles of plasma 12 move upward, other particles such as neutrals within or below $R_1$, move in to replace the upwardly moving particles. These neutrals, under some conditions, can drag with them charged particles.

For example, as a plasma moves upward, other particles at the same altitude as the plasma move horizontally into the region to replace the rising plasma and to form new plasma. The kinetic energy developed by said other particles as they move horizontally is, for example, on the same order of magnitude as the total zonal kinetic energy of stratospheric winds known to exist.

Referring again to FIG. 2, plasma 12 in region $R_1$ is moved upward along field line 11. The plasma 12 will then form a plume (cross-hatched area in FIG. 2) which will be relatively stable for prolonged periods of time. The exact period of time will vary widely and be determined by gravitational forces and a combination of radiative and diffusive loss terms. In the previous detailed example, the calculations were based on forming a plume by producing $0^+$energies of 2 ev/particle. About 10 ev per particle would be required to expand plasma 12 to apex point C (FIG. 1). There at least some of the particles of plasma 12 will be trapped and will oscillate between mirror points along field line 11. This oscillation will then allow additional heating of the trapped plasma 12 by stochastic heating which is associated with trapped and oscillating particles. See "A New Mechanism for Accelerating Electrons in the Outer Ionosphere" by R. A. Helliwell and T. F. Bell, Journal of Geophysical Research, Vol. 65, No. 6, June, 1960. This is preferably carried out at an altitude of at least 500 km.

The plasma of the typical example might be employed to modify or disrupt microwave transmissions of satellites. If less than total black-out of transmission is desired (e.g., scrambling by phase shifting digital signals), the density of the plasma ($N_e$) need only be at least about $10^6$ per cubic centimeter for a plasma orginating at an altitude of from about 250 to about 400 km and accordingly less energy (i.e., electromagnetic radiation), e.g., $10^8$ joules need be provided. Likewise, if the density $N_e$is on the order of $10^8$, a properly positioned plume will provide a reflecting surface for VHF waves and can be used to enhance, interfere with, or otherwise modify communication transmissions. It can be seen from the foregoing that by appropriate application of various aspects of this invention at strategic locations and with adequate power sources, a means and method is provided to cause interference with or even total disruption of communications over a very large portion of the earth. This invention could be employed to disrupt not only land based communications, both civilian and military, but also airborne communications and sea communications (both surface and subsurface). This would have significant military implications, particularly as a barrier to or confusing factor for hostile missiles or airplanes. The belt or belts of enhanced ionization produced by the method and apparatus of this invention, particularly if set up over Northern Alaska and Canada, could be employed as an early warning device, as well as a communications disruption medium. Further, the simple ability to produce such a situation in a practical time period can by itself be a deterring force to hostile action. The ideal combination of suitable field lines intersecting the earth's surface at the point where substantial fuel sources are available for generation of very large quantitities of electromagnetic power, such as the North Slope of Alaska, provides the wherewithal to accomplish the foregoing in a practical time period, e.g., strategic requirements could necessitate achieving the desired altered regions in time periods of two minutes or less and this is achievable with this invention, especially when the combination of natural gas and magnetohydrodynamic, gas turbine, fuel cell and/or EGD electric generators are employed at the point where the useful field lines intersect the earth's surface. One feature of this invention which satisfies a basic requirement of a weapon system, i.e., continuous checking of operability, is that small amounts of power can be generated for operability checking purposes. Further, in the exploitation of this invention, since the main electromagnetic beam which generates the enhanced ionized belt of this invention can be modulated itself and/or one or more additional electromagnetic radiation waves can be impinged on the ionized region formed by this invention as will be described in greater detail herein after with respect to FIG. 4, a substantial amount of randomly modulated signals of very large power magnitude can be generated in a highly nonlinear mode. This can cause confusion of or interference with or even complete disruption of guidance systems employed by even the most sophisticated of airplanes and missiles. The ability to employ and transmit over very wide areas of the earth a plurality of electromagnetic waves of varying frequencies and to change same at will in a random manner, provides a unique ability to interfere with all modes of communications, land, sea, and/or air, at the same time. Because of the unique juxtaposition of usable fuel source at the point where desirable field lines intersect the earth's surface, such wide ranging and complete communication interference can be achieved in a resonably short period of time. Because of the mirroring phenomenon discussed hereinabove, it can also be prolonged for substantial time periods so that it would not be a mere transient effect that could simply be waited out by an opposing force. Thus, this invention provides the ability to put unprecedented amounts of power in the earth's atmosphere at strategic locations and to maintain the power injection level, particularly if random pulsing is employed, in a manner far more precise and better controlled than heretofore accomplished by the prior art, particularly by the detonation of nuclear devices of various yeilds at various altitudes. Where the prior art approaches yielded merely transitory effects, the unique combination of fuel and desirable field lines at the point where the fuel occurs allows the establishment of, compared to prior art approaches, precisely controlled and long-lasting effects which cannot, practically speaking, simply be waited out. Further, by knowing the frequencies of the various electromagnetic beams employed in the practice of this invention, it is possible not only to interfere with third party communications but to take advantage of one or more such beams to carry out a communications network even though the rest of the world's communications are disrupted. Put another way, what is used to disrupt another's communications can be employed by one knowledgeable of this invention as a communications network at the same time. In addition, once one's own communication network is established, the far-reaching extent of the effects of this invention could be employed to pick up communication signals of other for intelligence purposes. Thus, it can be seen that the disrupting effects achievable by this invention can be employed to benefit by the party who is practicing this invention since knowledge of the various electromagnetic waves being employed and how they will vary in frequency and magnitude can be used to an advantage for positive communication and eavesdropping purposes at the same time. However, this invention is not limited to locations where the fuel source naturally exists or where desirable field lines naturally intersect the earth's surface. For example, fuel, particularly hydrocarbon fuel, can be transported by pipeline and the like to the location where the invention is to be practiced.

FIG. 4 illustrates another embodiment wherein a selected region of plasma $R_3$which lies within the earth's ionosphere is altered to increase the density thereof whereby a relatively stable layer 30 of relatively dense plasma is maintained within region $R_3$. Electromagnetic radiation is transmitted at the outset essentially parallel to field line 11 via antenna 15 as a right hand circularly polarized wave and at a frequency (e.g., 1.78 megahertz when the magnetic field at the desired altitude is 0.66 gauss) capable of exciting electron cyclotron resonance in plasma 12 at the particular altitude of plasma 12. This causes heating of the particles (electrons, ions, neutrals, and particulates) and ionization of the uncharged particles adjacent line 11, all of which are absorbed into plasma 12 to increase the density thereof. The power transmitted, e.g., $2\times10^6$ watts for up to 2 minutes heating time, is less than that required to generate the mirror force F required to move plasma 12 upward as in the previous embodiment.

While continuing to transmit electromagnetic radiation 20 from antenna 15, a second electromagnetic radiation beam 31, which is at a defined frequency different from the radiation from antenna 15, is transmitted from one or more second sources via antenna 32 into layer 30 and is absorbed into a portion of layer 30 (cross-hatched area in FIG. 4). The electromagnetic radiation wave from antenna 32 is amplitude modulated to match a known mode of oscillation $f_3$ in layer 30. This creates a resonance in layer 30 which excites a new plasma wave 33 which also has a frequency of $f_3$ and which then propogates through the ionosphere. Wave 33 can be used to improve or disrupt communications or both depending on what is desired in a particular application. Of course, more than one new wave 33 can be generated and the various new waves can be modulated at will and in a highly nonlinear fashion.

Figure 5:
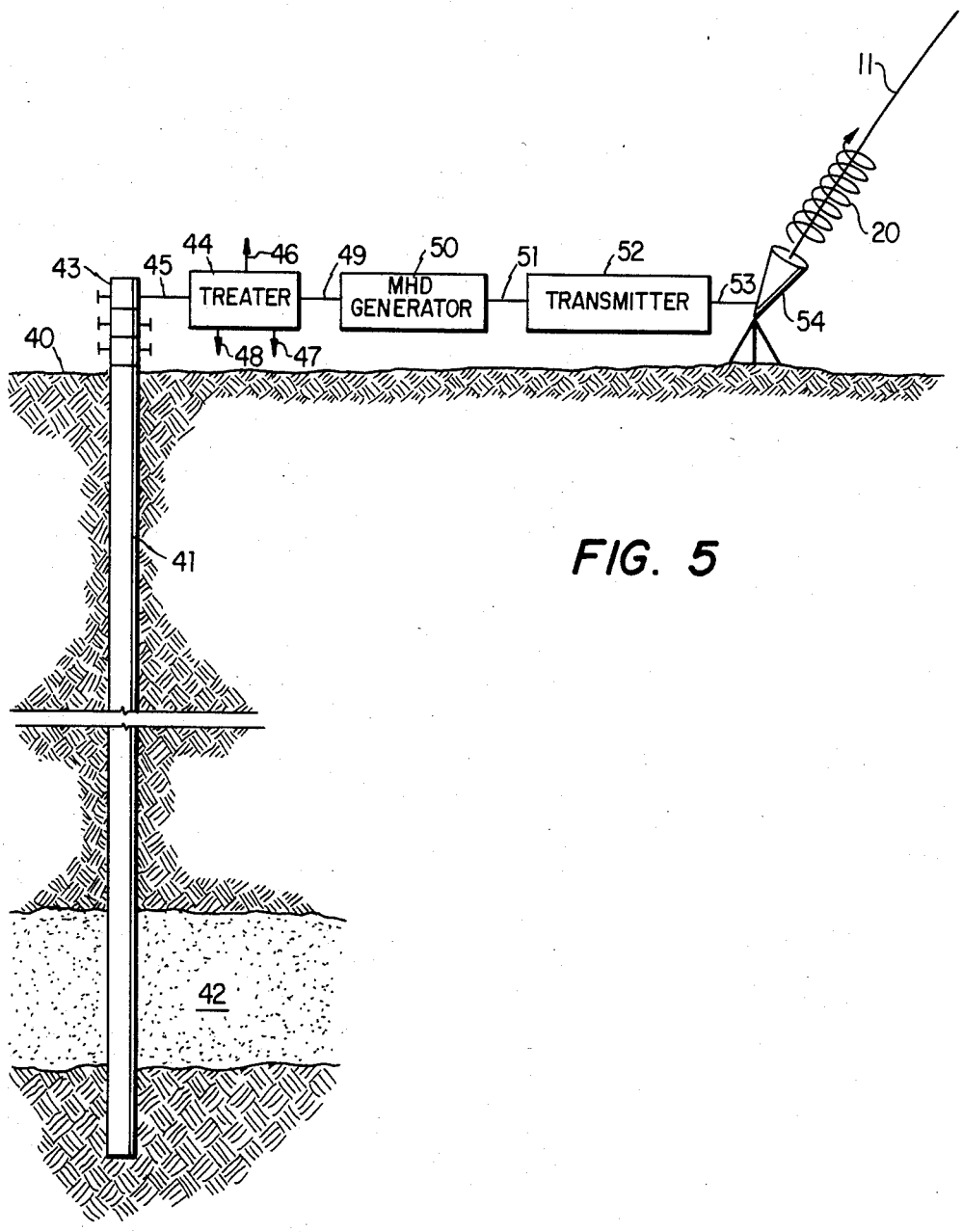
FIG. 5 is a schematic view of an apparatus embodiment within this invention.

FIG. 5 shows apparatus useful in this invention, particularly when those applications of this invention are employed which require extremely large amounts of power. In FIG. 5 there is shown the earth's surface 40 with a well 41 extending downwardly thereinto until it penetrates hydrocarbon producing reservoir 42. Hydrocarbon reservoir 42 produces natural gas alone or in combination with crude oil. Hydrocarbons are produced from reservoir 42 through well 41 and wellhead 43 to a treating system 44 by way of pipe 45. In treater 44, desirable liquids such as crude oil and gas condensates are separated and recovered by way of pipe 46 while undesirable gases and liquids such as water, $H_2S$, and the like are separated by way of pipe 47. Desirable gases such as carbon dioxide are separated by way of pipe 48, and the remaining natural gas stream is removed from treater 44 by way of pipe 49 for storage in conventional tankage means (not shown) for future use and/or use in an electrical generator such as a magnetohydrodynamic, gas turbine, fuel cell or EGD generator 50. Any desired number and combination of different types of electric generators can be employed in the practice of this invention. The natural gas is burned in generator 50 to produce substantial quantities of electricity which is then stored and/or passed by way of wire 51 to a transmitter 52 which generates the electromagnetic radiation to be used in the method of this invention. The electromagnetic radiation is then passed by way of wire 53 to antenna 54 which is located at or near the end of field line 11. Antenna 54 sends circularly polarized radiation wave 20 upwards along field line 11 to carry out the various methods of this invention as described hereinabove.

Of course, the fuel source need not be used in its naturally-occurring state but could first be converted to another second energy source form such as hydrogen, hydrazine and the like, and electricity then generated from said second energy source form.

It can be seen from the foregoing that when desirable field line 11 intersects earth's surface 40 at or near a large naturally-occurring hydrocarbon source 42, exceedingly large amounts of power can be very efficiently produced and transmitted in the direction of field lines. This is particularly so when the fuel source is natural gas and magnetohydrodynamic generators are employed. Further, this can all be accomplished in a relatively small physical area when there is the unique coincidence of fuel source 42 and desirable field line 11. Of course, only one set of equipment is shown in FIG. 5 for sake of simplicity. For a large hydrocarbon reservoir 42, a plurality of wells 41 can be employed to feed one or more storage means and/or treaters and as large a number of generators 55 as needed to power one or more transmitters 52 and one or more antennas 54. Since all of the apparatus 44 through 54 can be employed and used essentially at the sight where naturally-occurring fuel source 42 is located, all the necessary electromagnetic radiation 20 is generated essentially at the same location as fuel source 42. This provides for a maximum amount of usable electromagnetic radiation 20 since there are no significant storage or transportation losses to be incurred. In other words, the apparatus is brought to the sight of the fuel source where desirable field line 11 intersects the earth's surface 40 on or near the geographical location of fuel source 42, fuel source 42 being at a desirable magnetic latitude for the practice of this invention, for example, Alaska.

The generation of electricity by motion of a conducting fluid through a magnetic field, i.e., magnetohydrodynamics (MHD), provides a method of electric power generation without moving mechanical parts and when the conducting fluid is a plasma formed by combustion of a fuel such as natural gas, an idealized combination of apparatus is realized since the very clean-burning natural gas forms the conducting plasma in an efficient manner and the thus formed plasma, when passed through a magnetic field, generates electricity in a very efficient manner. Thus, the use of fuel source 42 to generate a plasma by combustion thereof for the generation of electricity essentially at the site of occurrence of the fuel source is unique and ideal when high power levels are required and desirable field lines 11 intersect the earth's surface 40 at or near the site of fuel source 42. A particular advantage for MHD generators is that they can be made to generate large amounts of power with a small volume, light weight device. For example, a 1000 megawatt MHD generator can be construed using superconducting magnets to weigh roughly 42,000 pounds and can be readily air lifted.

This invention has a phenomenal variety of possible ramifications and potential future developments. As alluded to earlier, missile or aircraft destruction, deflection, or confusion could result, particularly when relativistic particles are employed. Also, large regions of the atmosphere could be lifted to an unexpectedly high altitude so that missiles encounter unexpected and unplanned drag forces with resultant destruction or deflection of same. Weather modification is possible by, for example, altering upper atmosphere wind patterns or altering solar absorption patterns by constructing one or more plumes of atmospheric particles which will act as a lens or focusing device. Also as alluded to earlier, molecular modifications of the atmosphere can take place so that positive environmental effects can be achieved. Besides actually changing the molecular composition of an atmospheric region, a particular molecule or molecules can be chosen for increased presence. For example, ozone, nitrogen, etc. concentrations in the atmosphere could be artificially increased. Similarly, environmental enhancement could be achieved by causing the breakup of various chemical entities such as carbon dioxide, carbon monoxide, nitrous oxides, and the like. Transportation of entities can also be realized when advantage is taken of the drag effects caused by regions of the atmosphere moving up along diverging field lines. Small micron sized particles can be then transported, and, under certain circumstances and with the availability of sufficient energy, larger particles or objects could be similarly affected. Particles with desired characteristics such as tackiness, reflectivity, absorptivity, etc., can be transported for specific purposes or effects. For example, a plume of tacky particles could be established to increase the drag on a missile or satellite passing therethrough. Even plumes of plasma having substantially less charged particle density than described above will produce drag effects on missiles which will affect a lightweight (dummy) missile in a manner substantially different than a heavy (live) missile and this affect can be used to distinguish between the two types of missiles. A moving plume could also serve as a means for supplying a space station or for focusing vast amount of sunlight on selected portions of the earth. Surveys of global scope could also be realized because the earth's natural magnetic field could be significantly altered in a controlled manner by plasma beta effects resulting in, for example, improved magnetotelluric surveys. Electromagnetic pulse defenses are also possible. The earth's magnetic field could be decreased or disrupted at appropriate altitudes to modify or eliminate the magnetic field in high Compton electron generation (e.g., from high altitude nuclear bursts) regions. High intensity, well controlled electrical fields can be provided in selected locations for various purposes. For example, the plasma sheath surrounding a missile or satellite could be used as a trigger for activating such a high intensity field to destroy the missile or satellite. Further, irregularities can be created in the ionosphere which will interfere with the normal operation of various types of radar, e.g., synthetic aperture radar. The present invention can also be used to create artificial belts of trapped particles which in turn can be studied to determine the stability of such parties. Still further, plumes in accordance with the present invention can be formed to simulate and/or perform the same functions as performed by the detonation of a "heave" type nuclear device without actually having to detonate such a device. Thus it can be seen that the ramifications are numerous, far-reaching, and exceedingly varied in usefulness.

I claim:

1. A method for altering at least one region normally existing above the earth's surface with electromagnetic radiation using naturally-occurring and diverging magnetic field lines of the earth comprising transmitting first electromagnetic radiation at a frequency between 20 and 7200 kHz from the earth's surface, said transmitting being conducted essentially at the outset of transmission substantially parallel to and along at least one of said field lines, adjusting the frequency of said first radiation to a value which will excite electron cyclotron resonance at an initial elevation at least 50 km above the earth's surface, whereby in the region in which said electron cyclotron resonance takes place heating, further ionization, and movement of both charged and neutral particles is effected, said cyclotron resonance excitation of said region is continued until the electron concentration of said region reaches a value of at least $10^6$ per cubic centimeter and has an ion energy of at least 2 ev.

2. The method of claim 1 including the step of providing artificial particles in said at least one region which are excited by said electron cyclotron resonance.

3. The method of claim 2 wherein said artificial particles are provided by injecting same into said at least one region from an orbiting satellite.

4. The method of claim 1 wherein said threshold excitation of electron cyclotron resonance is about 1 watt per cubic centimeter and is sufficient to cause movement of a plasma region along said diverging magnetic field lines to an altitude higher than the altitude at which said excitation was initiated.

5. The method of claim 4 wherein said rising plasma region pulls with it a substantial portion of neutral particles of the atmosphere which exist in or near said plasma region.

6. The method of claim 1 wherein there is provided at least one separate source of second electromagnetic radiation, said second radiation having at least one frequency different from said first radiation, impinging said at least one second radiation on said region while said region is undergoing electron cyclotron resonance excitation caused by said first radiation.

7. The method of claim 6 wherein said second radiation has a frequency which is absorbed by said region.

8. The method of claim 6 wherein said region is plasma in the ionosphere and said second radiation excites plasma waves within said ionosphere.

9. The method of claim 8 wherein said electron concentration reaches a value of at least $10^{12}$ per cubic centimeter.

10. The method of claim 8 wherein said excitation of electron cyclotron resonance is initially carried out within the ionosphere and is continued for a time sufficient to allow said region to rise above said ionosphere.

11. The method of claim 1 wherein said excitation of electron cyclotron resonance is carried out above about 500 kilometers and for a time of from 0.1 to 1200 seconds such that multiple heating of said plasma region is achieved by means of stochastic heating in the magnetosphere.

12. The method of claim 1 wherein said first electromagnetic radiation is right hand circularly polarized in the northern hemisphere and left hand circularly polarized in the southern hemisphere.

13. The method of claim 1 wherein said electromagnetic radiation is generated at the site of a naturally-occurring hydrocarbon fuel source, said fuel source being located in at least one of northerly or southerly magnetic latitudes.

14. The method of claim 13 wherein said fuel source is natural gas and electricity for generating said electromagnetic radiation is obtained by burning said natural gas in at least one of magnetohydrodynamic, gas turbine, fuel cell, and EGD electric generators located at the site where said natural gas naturally occurs in the earth.

15. The method of claim 14 wherein said site of natural gas is within the magnetic latitudes that encompass Alaska.

* * * * *